US005669117A

United States Patent [19]

Spina

[11] Patent Number: 5,669,117

[45] Date of Patent: Sep. 23, 1997

[54] BUCKLE FOR LINE DANCING

[76] Inventor: Louis V. Spina, 1211 E. Dominick St., Rome, N.Y. 13440

[21] Appl. No.: 687,211

[22] Filed: Jul. 25, 1996

[51] Int. Cl.[6] ..... A44B 11/00

[52] U.S. Cl. ..... 24/163 K; 24/168; 224/163

[58] Field of Search ..... 24/163 K, 168; 224/163

[56] References Cited

U.S. PATENT DOCUMENTS

| | | | |
|---|---|---|---|
| 1,578,468 | 3/1926 | Rankin | 224/163 |
| 1,753,765 | 4/1930 | Withers | 224/163 |
| 2,836,351 | 5/1958 | Epstein | 224/163 |
| 4,502,188 | 3/1985 | Kohli | 24/163 K |
| 4,534,063 | 8/1985 | Krumin et al. | 224/163 |
| 4,753,377 | 6/1988 | Poluhowich | 24/163 K |
| 5,179,766 | 1/1993 | Matusek | 24/163 K |

*Primary Examiner*—Victor N. Sakran
*Attorney, Agent, or Firm*—Harris Beach & Wilcox, LLP

[57] ABSTRACT

A belt buckle for use in line dancing that includes a body section having thumb grips located on the top edge of the body section and finger grips located on the bottom edge thereof. The grips are provided with contoured seats so that the thumb and forefinger on each of the wearers hands can close over the buckle to firmly grasp the buckle while performing a line dance routine.

9 Claims, 2 Drawing Sheets

20
24
24
21

10
12
4
4
23
56

50
16
α
54
56
51

20
12
24

BUCKLE FOR LINE DANCING

BACKGROUND OF THE INVENTION

This invention relates to a belt buckle and, in particular to a belt buckle for helping a dancer in performing a line dance.

Line dancing has become a popular form of dancing that is not only entertaining, but also aerobically beneficial because of the amount of energy that is expended by the performer. Most experienced line dancers attempt to anchor their hands somehow when performing. They find this stabilizes their torso and prevents their arms from extending outwardly when doing the various dance steps. This, in turn, provides for a more pleasing and artistic performance. In addition, having an anchor point for the dancer's hands also tends to help the dancer maintain his or her balance while performing various maneuvers.

Typically, experienced dancers will place the fingers of both hands on any suitable part of their wearing apparel such as belt loops, pockets, belts or trouser inseams. Although these techniques are to some extent effective, they are not totally satisfactory because clothing tends to move or shift as the dance is being performed or the article grasped has insufficient surface area to afford a positive hand-hold, and as a consequence the hands tire and the wearer's grip weakened.

SUMMARY OF THE INVENTION

It is therefore a primary object of the present invention to improve a person's ability to perform when line dancing.

It is a further object of the present invention to provide an easily hand engageable article that can be worn by a line dancer to provide a stable anchor point for the dancer's hands while he or she is performing.

A still further object of the present invention is to provide a belt buckle having finger seats that facilitate a tight hold on the buckle during a line dance.

These and other objects of the present invention are attained by means of a belt buckle that can be worn by a line dancer. The buckle includes a body section that is attachable to both ends of a dancer's belt. A pair of contoured thumb seats are mounted upon the upper edges of the body section, and a pair of finger seats are mounted upon the lower edge of said body section. The seats are generally wider than the body section and are concave in form to provide surfaces for securely engaging the thumbs and forefingers of the wearer's hands. Preferably, the seats are integral with the body section of the buckle.

BRIEF DESCRIPTION OF THE DRAWINGS

For a better understanding of these and other objects of the present invention, reference will be made to the following detailed description of the invention which is to be read in association with the accompanying drawings, wherein.

DESCRIPTION OF THE INVENTION

Figures 1, 2, 3, 4:
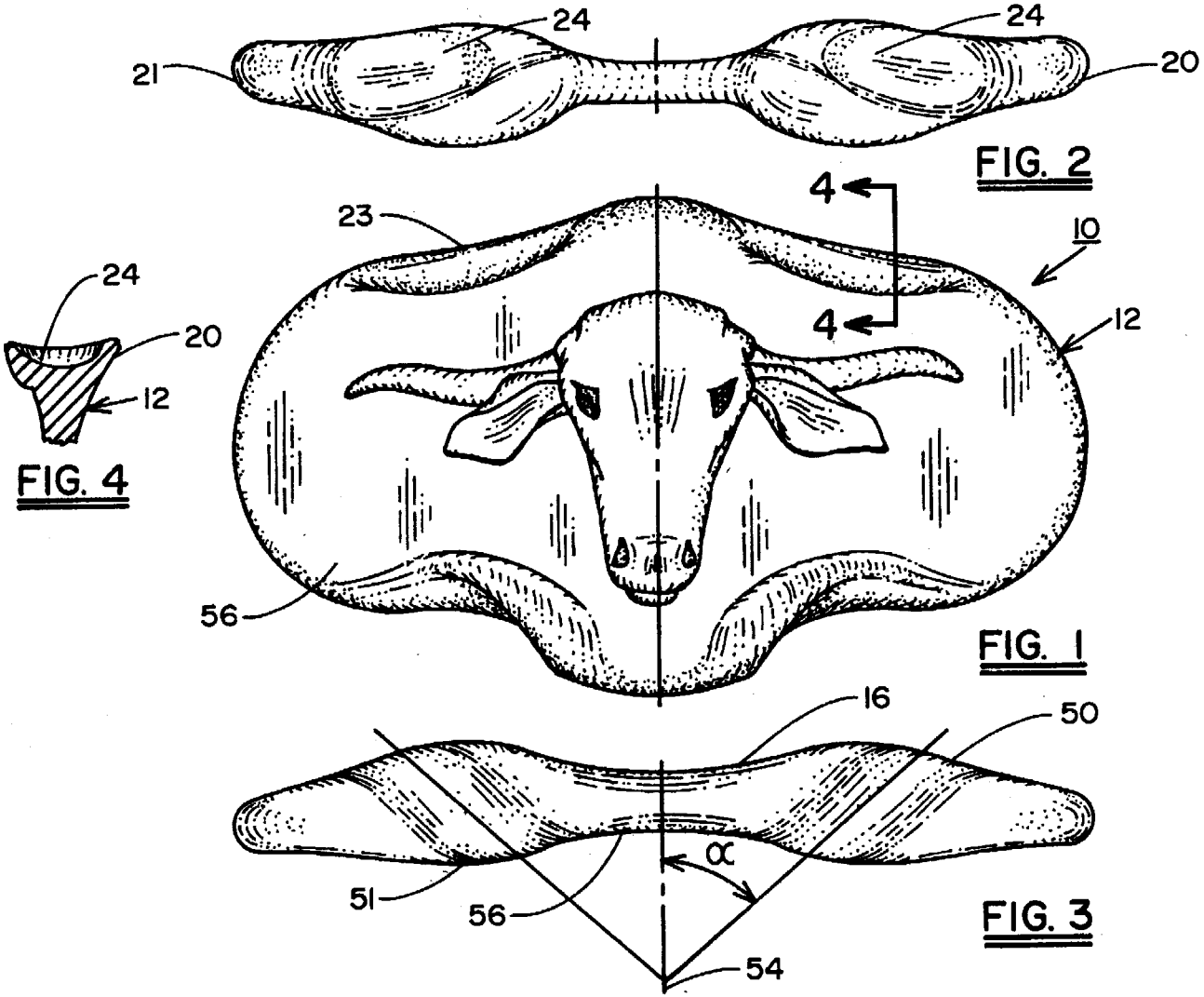
FIG. 1 is a front elevation showing a belt buckle embodying the teachings of the present invention.
FIG. 2 is top view of the belt buckle shown in FIG. 1.
FIG. 3 is a bottom view of the buckle.
FIG. 4 is a partial section taken along lines 4—4 in FIG. 1.

Turning initially to FIG. 1, there is illustrated a belt buckle generally referenced 10, that embodies the teachings of the present invention. The buckle includes a body section 12 that is slightly wider than it is high. The width of the buckle is about 5 inches and its height is about 2.5 inches. As will be noted below, the body of the buckle is of a size and shape to enable the wearer to firmly, yet comfortably, grip the buckle between the thumb and forefinger of each hand.

Figure 5:
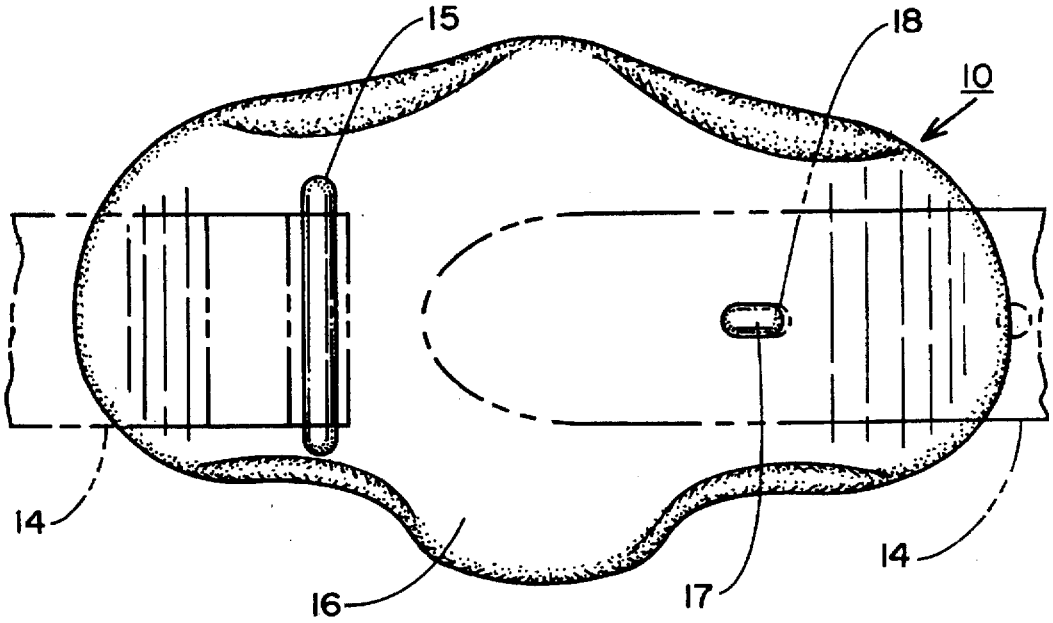
FIG. 5 is a rear elevation of the buckle.

As illustrated in FIG. 5, a belt loop 15 is mounted on the back face 16 of the body section which enables one end of a belt 14 to be passed through the loop and secured to the buckle. A hook 17 is also mounted on the back face of the body section and is arranged to pass through the belt holes 18 formed in the opposite end of the belt. The belt thus can be passed about the waist of a wearer and secured in place so as to position the buckle in front of the wearer's torso where it can be easily grasped by both hands of the wearer.

With further reference to FIGS. 2–4, a pair of thumb seats 20 and 21 are mounted upon the top edge 23 of the body section. Each grip contains a contoured saddle 24 that generally extends longitudinally along the upper edge of the body section. The seats are concave in form and are sufficiently wide so as to enclose a portion of the wearer's thumbs when they are placed in the seats. Each seat passes inwardly from a side edge of the body section a given distance that is substantially equal to the distance from the tip of an adult's thumb to the first joint of the thumb, which is typically between one and one half inches.

Figure 6:
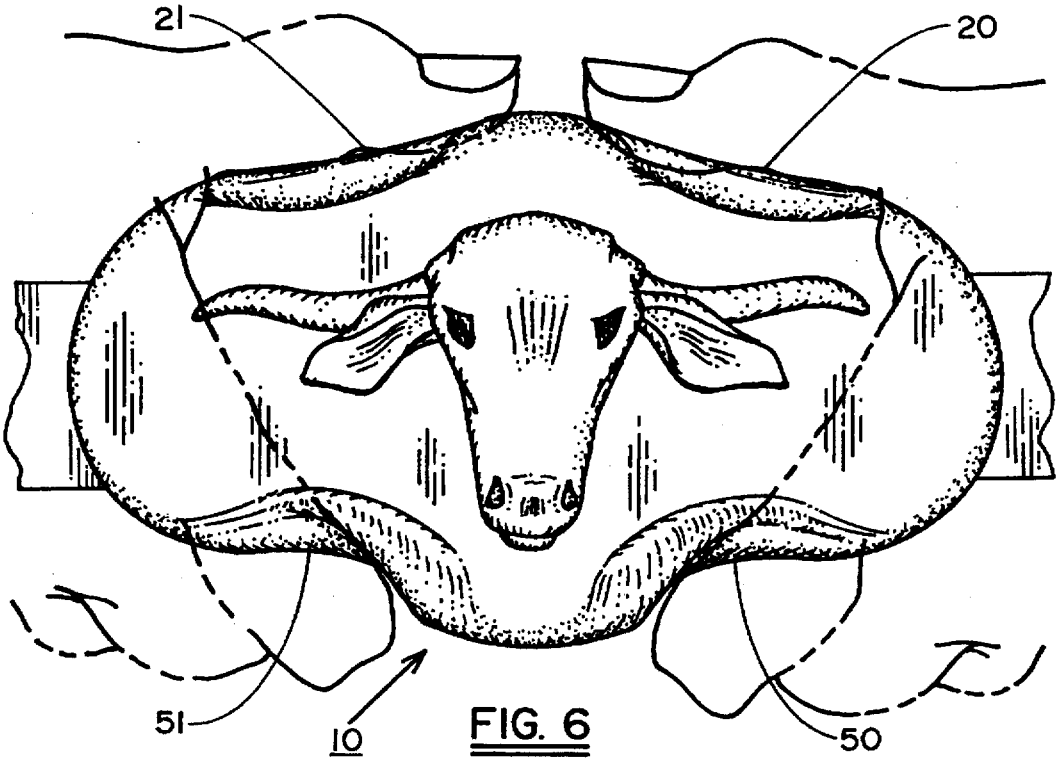
FIG. 6 is a front elevation similar to FIG. 1 showing the positioning of a performer's fingers when grasping the buckle.

A pair of finger seats 50–51 are also mounted upon the lower edge surface 51 of the body section. Here again, each grip is concave in form and is arranged to provide a partial enclosure for the wearer's forefinger. The finger seats pass over the body section at an angle which permits the thumb and forefinger of each hand to close naturally over the buckle, as illustrated in FIG. 6. The finger seats form an angle $\alpha$ of about between 40° and 50° with the centerline 54 of the buckle so that the finger seats slant inwardly from the front face 56 of the buckle toward the back face 16. The thickness of each seat is greater than that of the body section and provides sufficient surface area for the pedal digits so that the wearer is able to securely and comfortably grasp the buckle with both hands.

Preferably, the seats are integrally formed with the body section of the buckle to create a one piece structure. The buckle may be molded using any suitable plastic or cast from metal. The body section of the buckle is generally arcuate in shape to conform to the shape of the wearer's body bowing rearwardly about the centerline 54.

While this invention has been explained with reference to the structure disclosed herein, it is not confined to the details set forth and this invention is intended to cover any modifications and changes as may come within the scope of the following claims:

What is claimed is:

1. A belt buckle for use in line dancing that includes a body section having front and back faces and upper and lower edge surfaces, said body section further including connecting means for joining the buckle to a belt, a pair of contoured thumb seats mounted upon the upper edge surface of the body section, a pair of contoured finger seats mounted upon the lower edge surface of the body section whereby the wearer can securely grasp the buckle between the thumb and forefinger of each hand;

each seat being concave in form to at least partially encompass a wearer's thumbs and forefingers.

2. The belt buckle of claim 1 wherein said thumb seats extend longitudinally along the top edge surface of the body section.

3. The belt buckle of claim 2 wherein said finger seats are angularly disposed in relation to said lower edge surface of the body section so that the finger seats slant toward the center of the body section from the front face of the buckle toward the back face.

4. The belt buckle of claim 1 wherein said body section is arcuate shaped bowing rearwardly from the center thereof toward the opposite side edges.

5. The belt buckle of claim 1 wherein the thickness of the seats is greater than the thickness of the body section.

6. The belt buckle of claim 5 wherein the seats are integral with the body section.

7. The belt buckle of claim 6 wherein the belt buckle is molded from plastic.

8. The belt buckle of claim 6 wherein the buckle is cast from metal.

9. The belt buckle of claim 1 wherein the width of the body section is about twice its height.

* * * * *